United States Patent [19]

Salazar

[11] 4,287,893

[45] Sep. 8, 1981

[54] WEIGHT REDUCING BELT

[76] Inventor: Maria V. Salazar, 9505 Holmes Plz., Apt. 2, Omaha, Nebr. 68127

[21] Appl. No.: 52,301

[22] Filed: Jun. 26, 1979

[51] Int. Cl.[3] ..... A41C 1/00

[52] U.S. Cl. ..... 128/556

[58] Field of Search ..... 128/556, 521

[56] References Cited

U.S. PATENT DOCUMENTS 2,273,995 2/1942 Rogerson ..... 128/521

3,149,634 9/1964 Martin ..... 128/556

3,219,038 11/1965 Spanel ..... 128/556

3,310,052 3/1967 Ward, Jr. ..... 128/521

*Primary Examiner*—Doris L. Troutman

*Attorney, Agent, or Firm*—Hiram A. Sturges

[57] ABSTRACT

A weight reducing belt comprising an upwardly extending tightening section, preferably composed of elastic material, the side edges of which are connected to a connecting section, having substantially moisture impervious means covering the majority of its area.

8 Claims, 3 Drawing Figures

WEIGHT REDUCING BELT

BACKGROUND OF THE INVENTION

In the prior art there has been needed a reducing belt which tightly fits the body because of means for drawing it tight and which also has large areas of moisture impervious material, causing much sweating thereunder during exercising of the body for reducing the fat at a person's waist line.

Such a belt can be worn during exercises but is also effective when worn throughout all ordinar, activities of the day.

SUMMARY OF THE INVENTION

A major goal of this invention is to provide a weight reducing belt adapted to extend around a person's midsection and having large areas of substantially moisture impervious material, the belt having a tightening section for holding it firmly against the skin.

Another goal of this invention is to provide a belt as described which is over six inches in height and which is preferably shaped in such a way that in its relaxed unstretched state it is larger at the top than at the bottom.

Still another goal is to provide the belt described with vertical disconnection means for convenient removal such as hook assemblies.

A very important goal is to provide the concept of the tightening section being formed of elastic extending from the top of the belt to the bottom thereof.

DESCRIPTION OF THE PREFERRED EMBODIMENT

Figure 1:
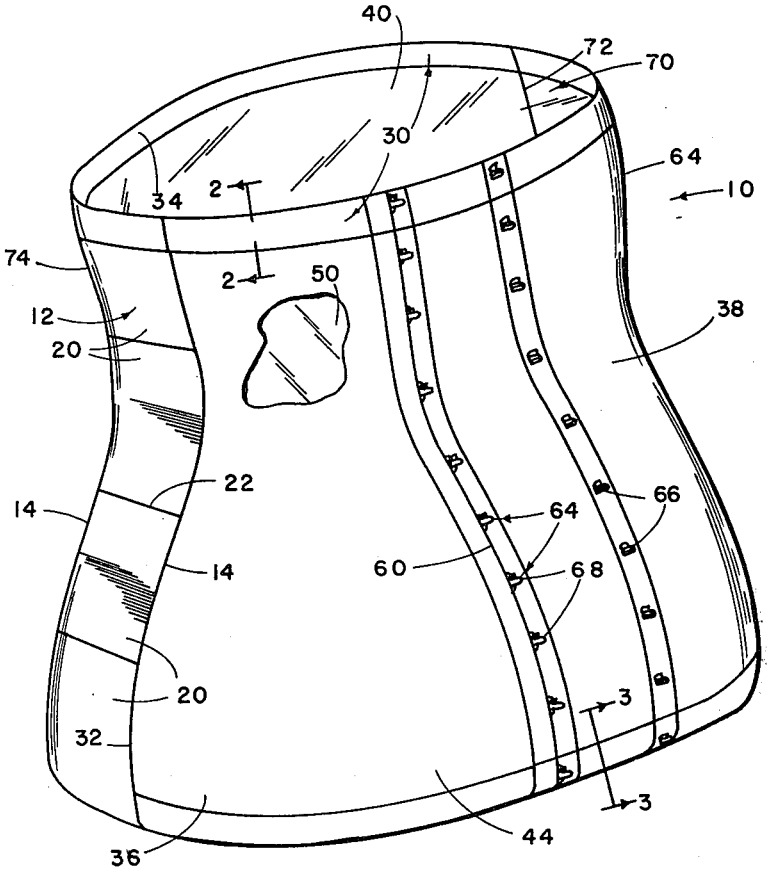
FIG. 1 is a perspective view of the reducing belt of this invention, as seen from the front and right side of a person wearing the belt, a portion of the belt forward layer is broken away to show the moisture impervious material there behind.

The weight reducing belt of this invention is generally indicated at 10 in FIG. 1, and comprises an upwardly extending tightening section 12, for tightening the belt around a person's body. The tightening section 12 having upwardly extending tight edges 14 at its forward and rearward sides.

The tightening section 12 is preferably composed of at least one upwardly extending panel of elastic flexible material, the panel having a plurality of sections 20, joined together by seems 22.

The reason for a plurality of sections 20 is because elastic is sold on the market in relatively small widths and the total height of a belt might be eleven inches, but in any case would be over six inches in height, and so as many as four elastic panel sections 20 might be needed to extend completely from the top to the bottom of the belt.

The belt can also have another elastic section later described.

The belt further has a connecting module generally indicated at 30, which latter is defined as the remainder of the belt 10, with the exception of the tightening section 12 and having ends 32 and 34 which are attached to the forward and rearward upwardly extending side edges of the tightening section 12.

Figure 2:
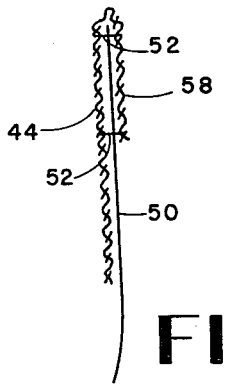
FIG. 2 is a cross-section of an upper portion of the belt in an area where a porous fabric extends upwardly over and down the back side of a layer of moisture impervious and non-porous material, the view being diagrammatic and in cross-section.

The connection module 30 is formed substantially entirely of flexible material, and preferably has two front panels 36 and 38, and one rear panel 40, each formed of a fabric covering 44, as best seen in FIG. 2, which extends over the forward side of a piece of moisture impervious non-porous flexible thermoplastic material 50, to which the fabric 44 is attached by stitching 52, the fabric 44 extending across the top of the plastic 50, and down the inner side in a portion 58, as seen in FIG. 2.

Figure 3:
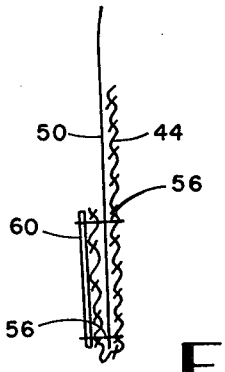
FIG. 3 is a cross-section of a bottom edge of the belt such as taken along the line 3—3 of FIG. 1, and showing a portion of the bottom of the belt in cross-section.

The underside of the thermoplastic piece 50 has fabric 44 bent around it and upwardly on the innerside thereof a short distance and stitched in places by stitches 56, and a soft felt material 60 can extend along the lower edge of the sections 36, 38 and 40, and extend up about a half inch and held in place by stitching 56, as best seen in FIG. 3. The section 36 is attached to the section 12 on one of its sides and is attached to section 38 at another of its sides, along a vertical opening 60, at which the sections 44 and 38 are held together by hook assemblies 64, which can be released.

A vertical row of eyes 66 is shown in FIG. 1, as an optional place to connect hooks 68 of the hook assemblies 64 to make the belt tighter.

The panel 38 is connected at a line 64 (which is hard to distinguish in the drawing FIG. 1 because the line 64 coincides with the position of the exterior of the whole belt as drawn) to an extra tightening section 70, which forms a part of the connecting module 30, the module 70 being made similar to the section 12 (in that it is also of elastic flexible material) and extending from top to bottom and having its rearward edge 72 attached to a vertical edge of the panel section 40, which latter has its own other edge attached at 74 to the rearward edge of the first tightening section 12.

The sections 36, 38 and 40 are each wider at the bottom than they are in the middle, and wider at the top than they are in the middle, so as to fit the waist line.

The particular shape shown in FIG. 1, is for a woman.

As thus described, substantially the entire belt is flexible, except for the hooks, but the tightening sections 12 and 70 are elastic or resilient in addition to being flexible. Although the tightening section 12 is of flexible stretchable resilient material, the majority of the remaining area of the belt is formed partially of felt which is not resilient.

It is because there is insufficient resiliency to the majority of the belt that it is necessary to have an elastic section 12 or else two elastic sections 12 and 70. It is well-known that felt is much less resilient than materials that are commonly known as elastic.

I claim:

1. A weight reducing belt of a length sufficient to cover a person's midsection, said belt having a vertically extending tightening section made of stretchable resilient material and having the majority of its remaining area formed of flexible material which is substantially impervious to moisture passage therethrough and which is substantially less resilient than said material of said tightening section, means connecting adjacent ends of said remaining area to said tightening section, said remaining area having therein two terminal end portions extending from top to bottom of said belt, means for adjustably connecting said two terminal end portions together so as to give said belt a greater or lesser interior size.

2. The weight reducing belt of claim 1 having said belt being over six inches high, said belt being of a length sufficient to encircle a person's mid-section.

3. The weight reducing belt of claim 1 having said belt being over six inches high, said belt being of a length sufficient to encircle a person's midsection.

4. The weight reducing belt of claim 1 having the majority of said remaining area having porous fabric outer cover means attached to substantially moisture impervious means disposed inwardly of said porous fabric outer cover means.

5. The weight reducing belt of claim 1 having said belt being of greater length at its top and bottom sides than at its central portion.

6. The weight reducing belt of claim 1 comprising said remaining area having therein two terminal end portions extending from top to bottom of said belt, means for adjustably connecting said two terminals end portions together so as to give said belt a greater or a lesser interior size.

7. The weight reducing belt of claim 1 having said tightening section (12) having a plurality of attached separate sections (20) disposed one above another.

8. The weight reducing belt of claim 1 having said remaining area of said belt having in it an extra tightening section (70) extending vertically.

* * * * *